US005427090A

United States Patent [19]

Hipskind et al.

[11] Patent Number: 5,427,090

[45] Date of Patent: Jun. 27, 1995

[54] PORTABLE BREATHING APPARATUS FOR AN ENCLOSED SPACE

[76] Inventors: Donald W. Hipskind, 201 Indian Trail, Lake In The Hills, Ill. 60102; Philip J. VanReeth, 1 Barko Pkwy., Huntley, Ill. 60142

[21] Appl. No.: 140,428

[22] Filed: Oct. 25, 1993

[51] Int. Cl.[6] ..... A62B 7/10; A62B 18/02; A62B 23/02; A62B 9/04

[52] U.S. Cl. ..... 128/205.12; 128/205.25; 128/202.27; 128/205.27; 128/201.25

[58] Field of Search ..... 128/201.22–201.25, 128/202.27, 205.12, 205.25, 205.27

[56] References Cited

U.S. PATENT DOCUMENTS

| | | | |
|---|---|---|---|
| 2,115,482 | 4/1938 | Crew . | |
| 2,914,064 | 11/1959 | Sandelowsky | 128/205.24 |
| 3,433,222 | 3/1969 | Pinto | 128/201.24 |
| 4,011,865 | 3/1977 | Morishita . | |
| 4,055,173 | 10/1977 | Knab | 128/201.23 |
| 4,300,496 | 11/1981 | Price | 128/202.13 |
| 4,331,141 | 5/1982 | Pokhis | 128/204.28 |
| 4,404,969 | 9/1983 | Cresswell et al. | 128/201.23 |
| 4,419,110 | 12/1983 | Ansite et al. | 128/202.27 |
| 4,478,216 | 10/1984 | Dukowski | 128/204.21 |
| 4,502,480 | 3/1985 | Yamamoto | 128/201.15 |
| 4,590,951 | 5/1986 | O'Connor | 128/204.23 |
| 4,649,912 | 3/1987 | Collins | 128/202.13 |
| 4,676,236 | 6/1987 | Piokowski et al. | 128/201.23 |
| 4,741,332 | 5/1988 | Beaussant | 128/201.23 |
| 4,796,615 | 1/1989 | Bullock et al. | 128/202.27 |
| 4,815,458 | 3/1989 | Sing | 128/201.25 |
| 5,003,974 | 4/1991 | Mou | 128/201.25 |
| 5,009,225 | 4/1991 | Vrabel | 128/201.23 |
| 5,265,592 | 11/1993 | Beaussant | 128/201.24 |

FOREIGN PATENT DOCUMENTS

| | | | |
|---|---|---|---|
| 794004 | 2/1936 | France | 128/201.25 |
| 2421328 | 11/1979 | France | 128/202.27 |
| 2558786 | 7/1976 | Germany | 128/201.25 |
| 288874 | 8/1971 | U.S.S.R. | 128/201.25 |

*Primary Examiner*—Kimberly L. Asher
*Attorney, Agent, or Firm*—Mathew R. P. Perrone, Jr.

[57] ABSTRACT

A breathing apparatus transports air through a hose to a mask which covers a person's face. An air source motor is connected to the mask by a hose separable by a snap fit device mounted on a belt to be worn around the waist of the mask wearer. The hose is long enough to provide for the motor being a distance away from the mask.

15 Claims, 3 Drawing Sheets

FIG. 3
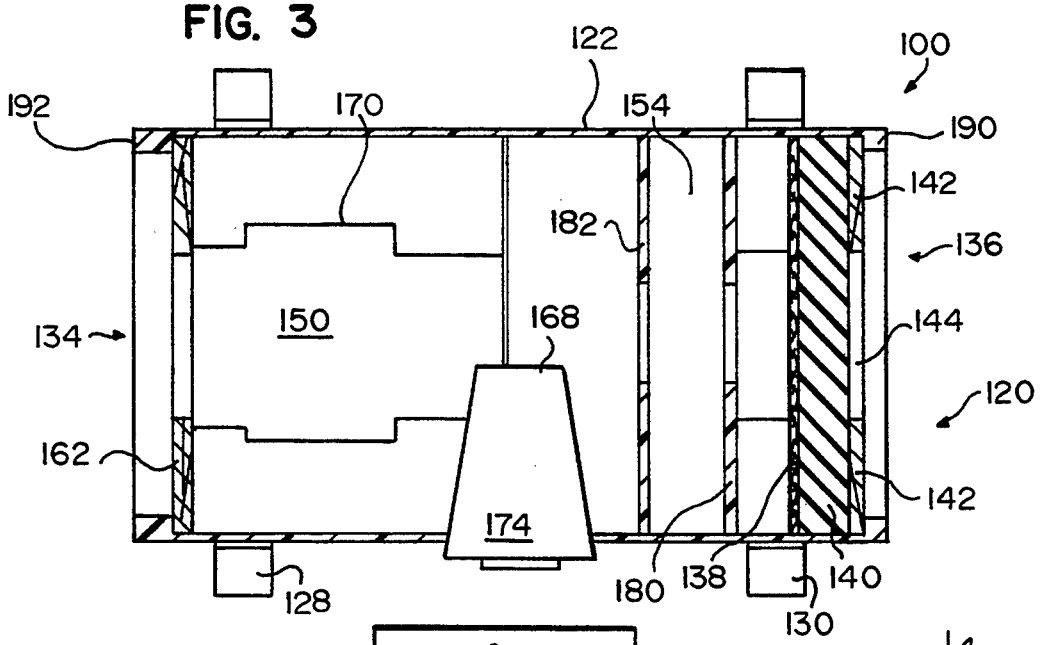
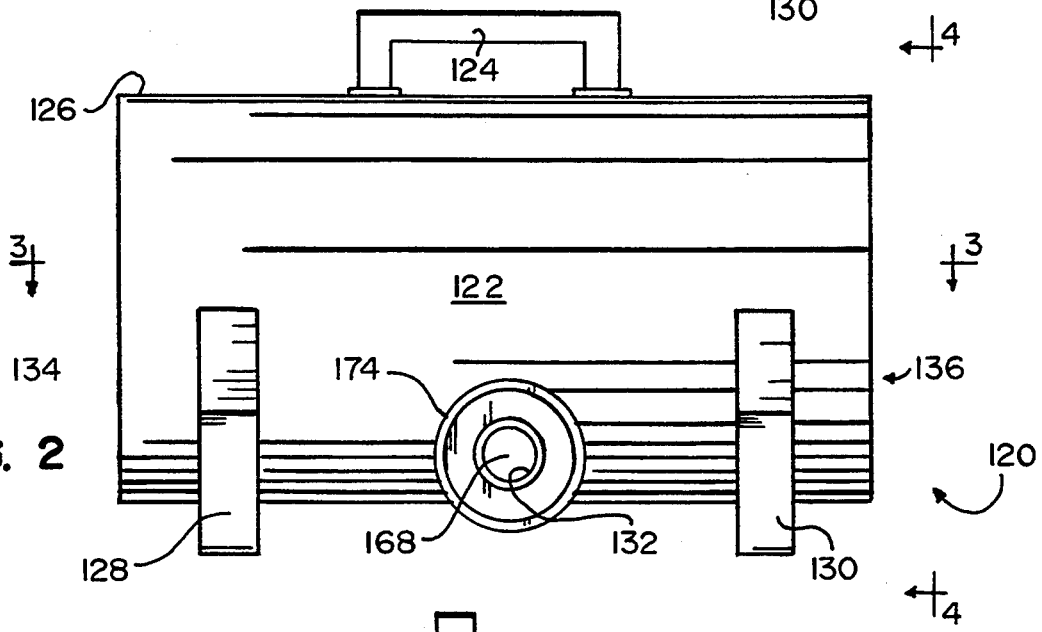
FIG. 2
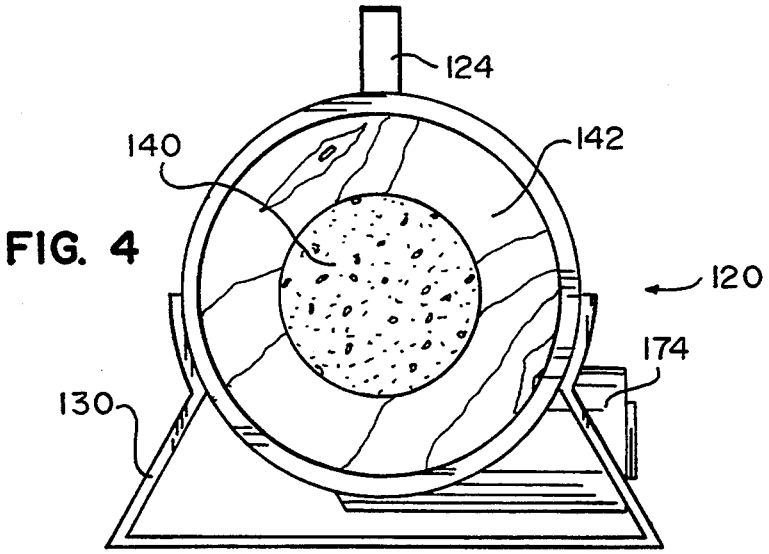
FIG. 4

FIG. 6
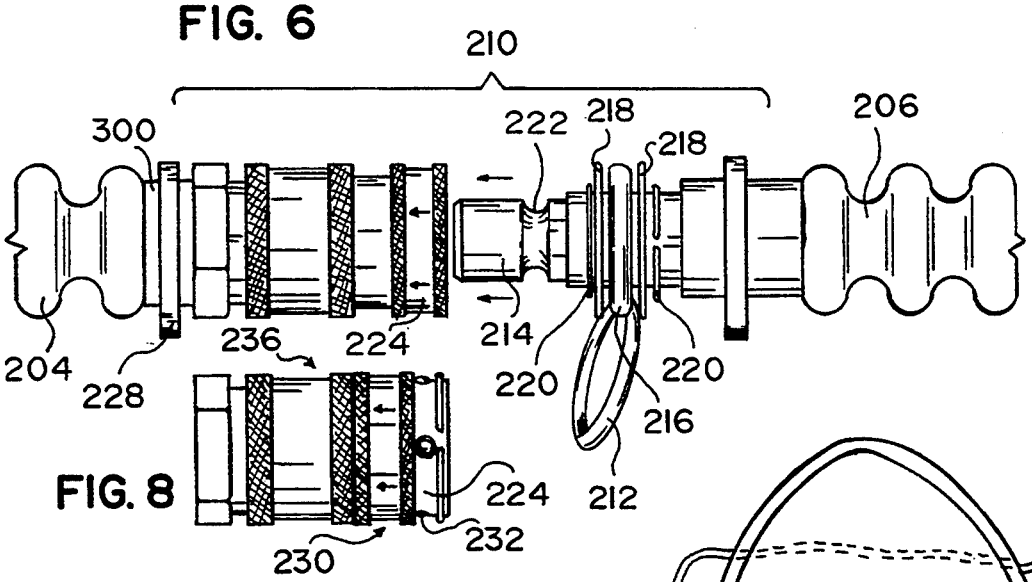
FIG. 8
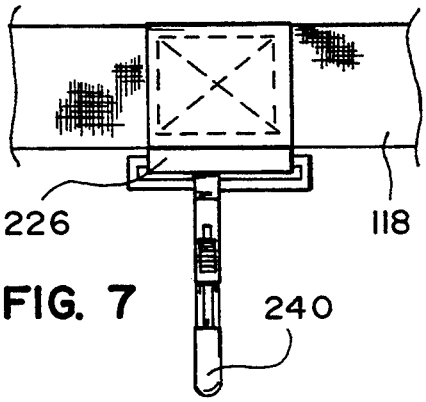
FIG. 7
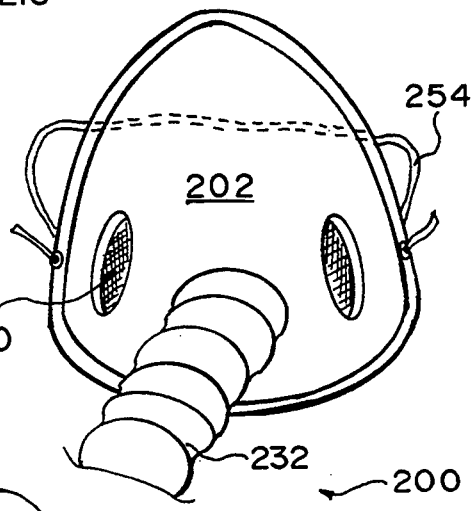
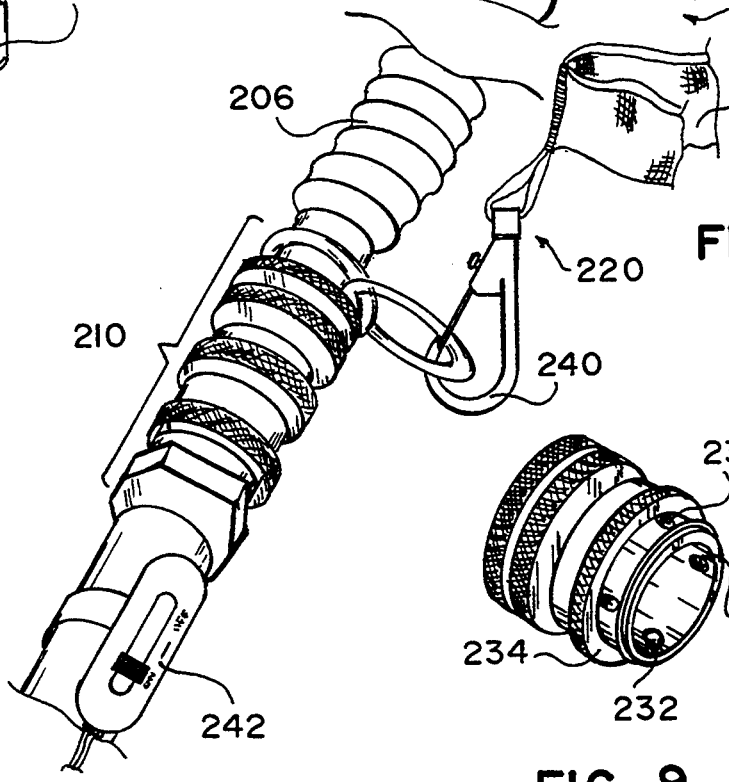
FIG. 5
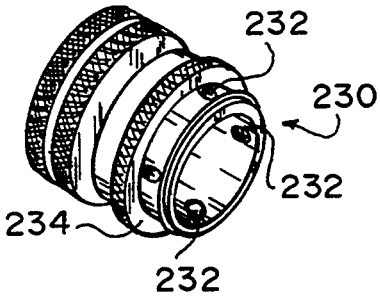
FIG. 9

PORTABLE BREATHING APPARATUS FOR AN ENCLOSED SPACE

This invention relates to a method and apparatus for providing breathable air to an enclosed space and more particularly to a method and apparatus for providing low pressure breathable air to an enclosed space.

BACKGROUND OF THE INVENTION

Many times it is desirable, if not required, to work in an enclosed space with a chemical or other substance, which may have an adverse effect on breathing. When working in this enclosed space, it is sometimes difficult to have proper breathing air.

A typical situation, which requires fresh air to breath, occurs when spray paint is being applied to a surface, such as a vehicle or similar substrate, in an enclosed space. It is also sometimes difficult to breath in a wood shop because of the saw dust in the air. It is definitely desirable to provide a simple method and apparatus for bringing outside or filtered air into the area where the air is contaminated by the work being done.

In many cases, it is also desirable to protect the face, in addition to the providing suitable air for a person to breathe. It is desired to protect the person's face from powder or dust or spray in an enclosed area. Typical of areas having a problem like is a wood shop or a painting shop. The painting processes of particular danger to the face are, to repeat, those wherein vehicles are painted.

It is also desired to protect people from a harmful mist or poisonous gas. Further, a sanitary aspect can be a requirement for means of protection too. If the person can breath sanitary air in a usually unsafe area, appropriate desirable results can be obtained. Yet, it is difficult to achieve this desired result of clean air to breathe, especially in an enclosed space.

While many items suitable for these purposes are known, these devices tend to be complicated and expensive. It is desirable to achieve these useful results at lower expense and with greater efficiency and less complication. If all of these factors can be maximized, a substantial advantage can be obtained.

A number of situations, where unpolluted and wholesome air is not available for breathing, exist. It is desired to replace that air, at least for breathing purposes, with air which is more appropriate for breathing and less harmful to the health. If this can be done efficiently, fumes from industrial areas or mines, especially those related to noxious gases, poisonous fumes and irritating particulate matter, can be avoided.

Protective masks of the prior art used in these situations tend to be cumbersome and confining. It is desirable to have flexibility and mobility while at the same time achieving comfortable use and efficient work.

Prior art reveals that other airline respirators are in use for provision of breathable air, but only with high pressure compressors being used as an air source. This high pressure air is sent to a regulator which is pressure-adjusted by the user to control the amount of air supplied. The regulator adds much to complication of the device. While a high pressure compressor may be necessary to get the right amount of air to the right place at the right time, the regulator is necessary to reduce the air pressure to point, so the air can be breathed. Elimination of the regulator and its inherent complications is clearly desirable.

Prior art also reveals that there is a therapeutic apparatus capable of providing low pressure/high volume or air, to augment the lung function of the person. This apparatus positions a motor indoors to draw room air through a hose to the person's lungs. Also that device uses a very low volume of air and is intended to assist a person to breath, when that person suffers from pulmonary or cardiac disease. It is, however, not capable of heavy-duty use, especially in a workshop or other industrial use.

Many safety factors must be considered for an air supply device to be useful. The device must be easily attached to and removed from the person. The air must be supplied efficiently. The air must be filtered. The masks or other breathing mechanism must be comfortable and flexible.

Wearing a device to assist breathing can be cumbersome. Using other equipment while wearing the breathing device requires that mobility be maintained, while appropriate air for breathing is supplied.

These requirements, for good air while working in an enclosed space with an undesirable substance or cumbersome equipment, cause difficulty in that the various requirements thereof result in a contrary situation. By contrary situation is meant that when the advantage of one item (such as breathable air) is maximized, another, equally important item (such as mobility to use equipment) is handicapped. A typical example is the above-referenced vehicle painting. It is thus desirable to provide the necessary safety and breathable air while at the same time leaving room for flexibility and escape mechanisms.

SUMMARY OF THE INVENTION

Among the many objectives of this invention is the provision of breathing apparatus having a low pressure air source feed air to a mask through with a flexible air hose attached therebetween.

A further objective of this invention is to provide a breathing apparatus for providing sanitary air to an enclosed space.

A still further objective of this invention is to provide a breathing apparatus for use in a dust filled environment.

Yet a further objective of this invention is to provide a breathing apparatus which is easily disconnected.

Also an objective of this invention is to provide a breathing apparatus, which is easily controlled.

Another objective of this invention is to provide a breathing apparatus, which is usable in poisonous environment.

Yet another objective of this invention is to provide a breathing apparatus for use in an industrial area.

Still another objective of this invention is to provide a breathing apparatus for use in a mine area.

A further objective of this invention is to provide a method for providing sanitary air to an enclosed space.

These and other objectives of the invention (which other objectives become clear by consideration of the specification, claims and drawings as a whole) are met by providing a breathing apparatus to pass air to a mask. An air source motor connected by a hose to a snap fit device mounted on a belt to be worn. The hose is flexible and easily controlled due to an easily disconnection of the snap fit device. A second hose section mounted at the belt to the snap fit device runs to mask.

BRIEF DESCRIPTION OF THE DRAWINGS

FIG. 2 depicts a top, plan, cross-sectional view of the motor unit 120 of breathing apparatus 100.

FIG. 3 depicts a side view of motor unit 120 of breathing apparatus 100.

FIG. 4 depicts an end, plan view of motor unit 120 of breathing apparatus 100.

FIG. 5 depicts a perspective view of the mask assembly 200 for the invention.

FIG. 6 depicts a side view of the hose disconnection assembly 210.

FIG. 7 depicts a front, plan view of belt clip 220 for use with breathing apparatus 100.

FIG. 8 depicts a side view of bearing assembly 230 in retract position 236.

FIG. 9 depicts a perspective view of bearing assembly 230.

Throughout the figures of the drawings, where the same part appears in more than one figure of the drawings, the same number is applied thereto.

DESCRIPTION OF THE PREFERRED EMBODIMENTS

Figure 1:
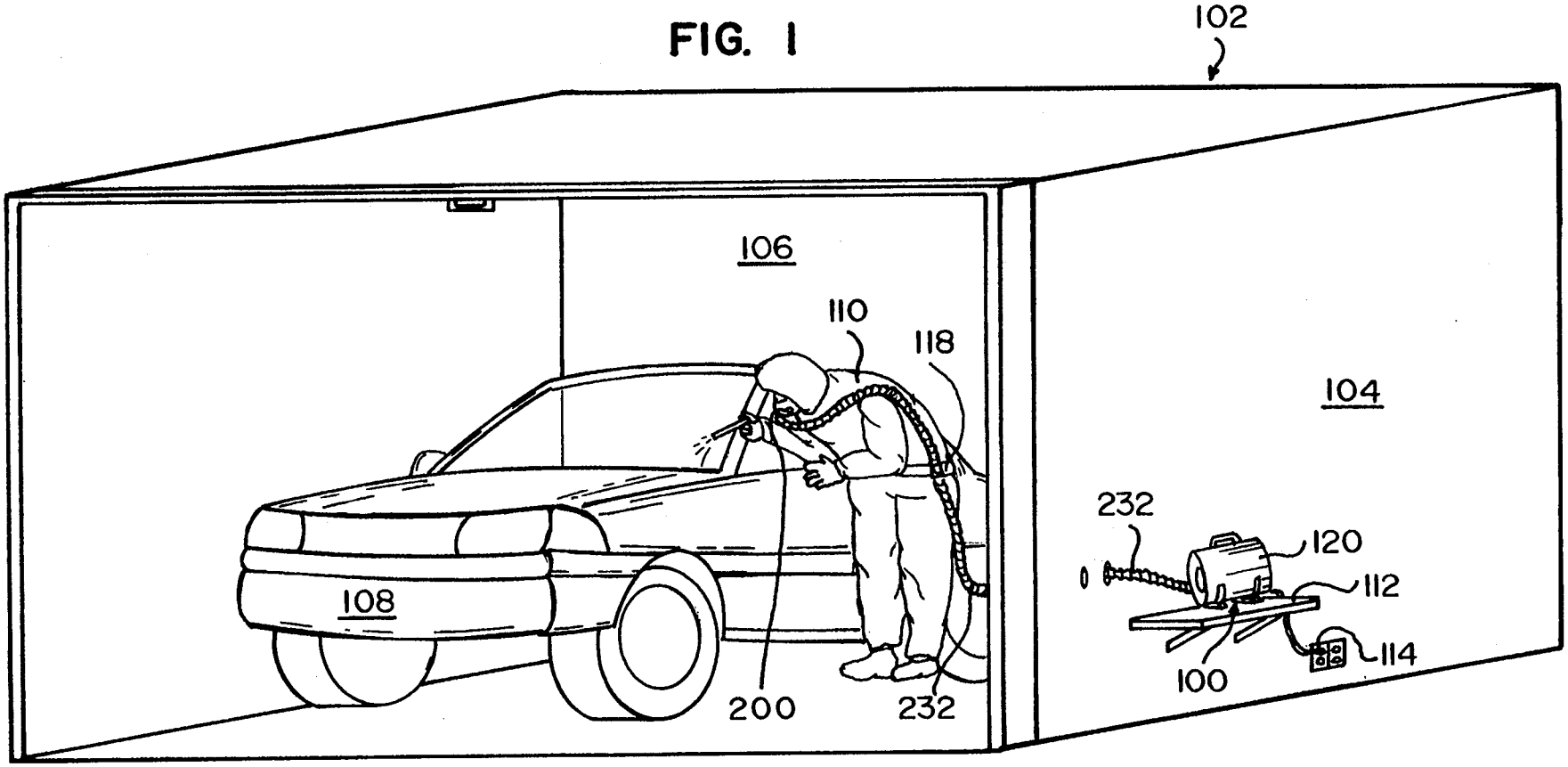
FIG. 1 depicts a perspective view of the breathing apparatus 100 in use.

This invention relates to a breathing apparatus, such as a portable airline breathing device, which positions the air source motor outside of the enclosed work area and has to do particularly with a breathing device, which provides air to a person, without placing a strain on the mask. The wearer of the mask receives fresh air from outside the enclosed area, and avoids breathing of the air in the enclosed room.

This invention has to do with a fresh air supplying apparatus for use by persons involved in painting, varnishing, or using other toxic chemicals in an enclosed work space where fresh breathable air can be polluted by the material being used in the enclosed space. The main idea is to provide a safe, easy to use, and portable respiration system for anyone anytime an alternate source of air is needed within an enclosed space.

Notable exceptions, for which the apparatus of this invention is not applicable, include use under water, use for fire fighting or a similar use. Such uses require a more complicated device. The apparatus of this invention is designed for ease of use by a person in an enclosed space, during a spray painting or similarly hazardous situation.

More particularly, this breathing apparatus provides appropriate air for a work area. The apparatus brings in at least Grade D air or better ambient air filtered and delivered through a flexible hose (such as a five eighths inch non-toxic hose or equivalent) into a face mask to a person working in an enclosed area where non toxic, clean breathable air is not available. By Grade D air is meant the air which is rated as safe to breathe by the Office of Health and Safety Administration.

A snap fit for quick release of the hose from the blower is secured to the belt of the user. This avoids pressure on the mask as the person moves about the work area. The flexible hose from the air source to the belt provides for this movement.

With the snap fit for the quick release, a belt ring is mounted on a dual ended male piece. The dual ended male piece is preferably a tubular member having a groove encircling one end on the outside of the tube. Centrally located on the dual ended male piece is a holding ring for the snap ring. Washers on either side of the holding ring are positioned on the male piece by clips or another suitable device. On one end of the male piece is a groove. The groove is received into the hose connector.

On the hose connector is a bearing assembly. The bearing assembly has at least two and preferably four spring loaded ball bearings radially spaced about the connector. The spring loaded ball bearings are held in position by a slidable ring which retracts toward the hose in order to permit the bearings to be pushed in an outwardly fashion. As the spring loaded retracting ring is retracted the bearings are forced in an outward fashion.

The male piece can slip into female piece, and the bearings can lock in the groove. When the spring loaded ring is released the bearings are firmly locked in the groove merely moving the spring loaded ring permits an easy release of the air source motor from the mask. Such separation permits a quick exit from the enclosed space in the event of equipment failure or other danger.

The hose may be is merely clipped on to the other side of the male piece. Alternatively, a second ball bearing assembly for a quick release on can be used. However, this is duplicative and may not be necessary in all cases.

This particular structure of having the quick release located directly at the belt avoids direct pressure on the mask. Thus, the mask hose is connected directly to the belt with the ring locking the hose in position on the belt. So when the person moves, the hose from the blower to the male member merely moves without applying pressure to the mask. This is especially true in view of the belt clip.

This invention uses a low pressure/high volume air source from a blower motor at the minimum air flow of at least five liters per minute to a face mask that a user can breath comfortably with even while working. There is enough air supplied to the face mask to provide positive pressure within the mask. That is to say, enough pressure is provided so that inlet air is continuously flowing out the exhalation valves. More preferably, the minimum air flow is about five to about 25 liters per minute. Most preferably, the minimum air flow is about ten to about 20 liters per minute.

Referring now to FIG. 1, a perspective view of breathing apparatus 100 of the invention is shown in operation. More particularly, the breathing apparatus 100 is exemplified as shown by use in garage 102. Motor unit 120 is mounted on the outside 104 of garage 102. Hose 232 passes from the outside 104 into the interior 106 of garage 102.

Depicted therein is a vehicle 108 with a person 110 spray painting the vehicle 108. The person 110 is wearing the mask assembly 200. Hose 232 is controlled by person 110 due to an attachment at belt 118. The motor unit 120 stands on a shelf 112 outside of the garage 102. This shelf 112 of course has a sufficient electrical outlet 114 thereby for the purpose of powering an electrical version of the motor unit 120. Motor unit 120 may have another power source.

Within FIG. 2 is a preferred depiction of the motor unit 120 and its housing 122. The housing 122 includes a handle 124 secured to the top 126 thereof for the purpose of simplifying the carrying of the device 100. Oppositely disposed from the handle 124 on the housing 122 are two stands including a first stand 128 and a second stand 130 to provide for standing the motor unit 120 in the proper place. Situated between the stands is the case hose attachment 132, which provides an outlet for air collected by the motor unit 120 to be used by the person 110.

Both first stand 128 and second stand 130 are substantially symmetrical. They each have an arcuate side to contact the housing 122 and an oppositely disposed flat side to provide support for standing the motor unit 120 in place. The first stand 128 and second stand 130 may also be made of any suitable material, such as wood or plastic.

Adding FIG. 3 to the consideration of FIG. 2, a top cross section view of the housing 122 is depicted. A motor end 134 is oppositely disposed from an intake end 136 in housing 122. Motor end 134 receives motor 150. Intake end 136 receives the air drawn in, and avoids air contact with motor 150.

A typical example of a motor suitable for use as motor 150 is the Model 116392-01 of a blower motor available from AMETEK. More specifically AMETEK has the motor available from its Lamb Electric Division of Kent, Ohio.

Adjacent to the intake end 136 is a screen 138. Adjacent to the screen 138 is a filter 140, which can be suitably treated to remove gas, particles or combinations thereof. Of course, screen 138 supports the filter 140 and prevents the suction of motor 150 from adversely affecting the filter 140. Because of screen 138, filter 140 cannot be drawn into housing 122. Oppositely disposed from the intake or first screen 138 on the other side of the filter 140 is filter spacer 142. Filter spacer 142 is adjacent intake end 136 of housing 122. Filter spacer 142 partially closes intake end 136 with a filter aperture blower air inlet 144, which permits the air to be brought in by the motor unit 120.

The motor unit 120 and specifically motor 150 draw the air in through the air inlet 144 and forces it out through the exhaust port 168. Hose 232 is connected to motor unit 120 at exhaust port 168 in any standard fashion. A standard snap connection is preferred for case hose attachment 132. In this manner, direct air contact with the blower motor 150 is avoided. Motor unit 120 is powered electrically or by any other suitable method.

Motor 150 is any commercially available blower motor, as above stated. Case 122 must be constructed to both receive motor 150 and direct air to the case hose attachment 132. This construction of case 122 provides great advantages for this breathing apparatus 100.

A simplified method of making the case 122 of the motor unit 120 is by using a heavy wall polyvinyl chloride pipe standardly available (preferably having a diameter of about six inches or 15 centimeters). A spacer 162 supports the blower motor 144. The spacer 16.2 can be made of plywood, plastic or other suitable material.

Attention is now directed to FIG. 2, FIG. 3 and FIG. 4. FIG. 2 shows the outside side view of the motor unit 120. FIG. 3 is the end view showing of the air intake end 160 of the housing 122 of the motor unit 120 noting that the motor 150 is encased in a tubular (preferably plastic) housing 122 making it very portable and compact. Also noted in this view is the exposed filter 140 and the area through which intake air passes; the exhaust air manifold 174 and leg support configuration, from legs 128 and 130.

FIG. 3 presents a cutaway sideview of the motor unit 120. It depicts the external housing 170 which encases a vacuum motor 150 within housing 122, such as a 220 volt vacuum motor which, when plugged into a 110 volt outlet, allows it to run at half speed thereby substantially extending its duty life.

The motor 150, which is located in the external housing 170, is a standardly available motor having a first impeller and a second impeller. The impellers serve to route the incoming air away from the motor 150 itself and minimize the treatment of the air and air contact with the motor 150. This style of motor 150 serves to double the air volume at the exhaust port 168.

With the exhaust port 168 between the motor 150 and inboard end 154, air contact with the motor 150 is minimized. Between the exhaust port 168 and the filter 140 are first housing support 180 and second housing support 182. Both first housing support 180 and second housing support 182 are circular, donut-shaped, apertured disks mounted in housing 122. Air from filter 140 passes therethrough to exhaust port 168.

To support the filter 140 on the inboard end 154 of the intake end 136, a first circular spacer 190 is positioned on the outboard end 156 of the external housing 170 to support it there. A second circular spacer 192 is positioned at the opposite motor end 134 of the external housing 170, which is used to both enclose and support the end of the motor 150.

The exhaust port 168 is situated in the exhaust air manifold 174, which in turn picks up the drawn in fresh air, sending it to the mask assembly 200 (shown in FIG. 5) through air delivery hose 232. Air delivery hose 232 is connected to exhaust air manifold 174 at case hose attachment 132. Also air delivery hose 232 is connected to the person 110 by belt clip 220 in FIG. 7 and ultimately to the face mask 202.

This invention provides a more inexpensive and simpler system of providing filtered breathable air to a person 110 involved in an enclosed area where fresh air is not otherwise available. Unlike an air purifying device, the breathing apparatus 100 if this invention draws air in from an outside, clean air, environment up to 25 meters and farther away from (or closer to) the actual enclosed work area; filters it; and sends it through hose 232 to the face mask 202 securely mounted on the head of person 110. Lungs, which cannot stand the immediately surrounding, polluted air, instead breath fresh air delivered by this device.

Also by arranging the structure of the air source motor 150 such that air to be breathed does not encounter the motor 150 itself, the breathing apparatus 100 eliminates problems that arise relating to the ionization of and other problems with the air prior to being breathed. Also the air remains at the same temperature as the ambient air as it is not allowed to warm as the temperature of the motor 150 increases.

In FIG. 5, depicted is the mask assembly 200 for the invention. The mask assembly 200 includes the belt clip 220, and the hose disconnection assembly 210. The hose disconnection assembly 210 permits an immediate separation so that the person 110 wearing the mask 202 can more easily avoid any problem which may occur, by quickly separating from motor 150 and leaving the enclosed space such as garage 102. Hose disconnection assembly also 210 avoids pressure on the mask assembly 200 as the person 110 moves about the work area.

As part of the mask 202, the following are included: exhalation valves 250, which are one way valves that secure efforts to breath in the air and provide for exhaling. The mouthpiece adapter 252 connects to the convoluted hose 232 for air to pass therethrough and straps 254 that securely fasten the mask 202 to the head of person 110.

Also attached to the hose 232 is a switch 242 connected the blower motor 150, so that the blower motor 150 may be operated by the wearer of the mask 202. This switch 242 is connected, of course, to the blower motor 150 in a standard fashion.

FIG. 6 and FIG. 8 show hose 232 as including flexible blower hose 204, mask hose 206 and hose disconnection assembly 210. The flexible blower hose 204 runs from the case hose attachment 132 to the hose disconnection assembly 210. The mask hose 206 runs from the dual ended male piece 214 to the mask 202. On the hose disconnection assembly 210, a snap fit is provided for the quick release of mask assembly 200 from flexible blower hose 204.

Included in hose disconnection assembly 210 are a belt ring 212 attached to a dual-ended male piece 214. Centrally located on the dual ended male piece 214 is a holding ring 216 for the belt ring 212. Holding ring 216 surrounds dual ended male piece 214 and interlocks with belt ring 212 to attach hose disconnection assembly 210 to belt 118.

Belt ring 212 fits into belt clip 240. Washers 218 on either side of the holding ring 216 are positioned by two clips 220 secured on the male piece 214 by a snapping mechanism. Thus, belt ring 212 is firmly positioned on male piece 214.

Mask hose 206 is slidably mounted onto and secured on the male piece 214 opposite a groove 222 and holding ring 216 by hose clamp 228 or a similar device. An adhesive or other appropriate can also be used to secure mask hose 206 to male piece 214. A second hose disconnection assembly 210 may also be inserted between blower hose 204 male piece 214 to replace hose clamp 228, provided a second groove 222 is in male piece 214.

By adding FIG. 8 and FIG. 9 to the consideration, within the hose connector 224 is a bearing assembly 230. The bearing assembly 230 has four spring loaded ball bearings 232 radially spaced about the connector 224. Ball bearings 232 have a default position which release the hose connector 224 from groove 222.

The operation of the hose disconnection assembly 210 becomes clear. Situated on one end of the male piece 214 is groove 222. Groove 222 encircles one end of the male piece 214. The groove 222 is received into the hose connector 224. Groove 222 then receives the four spring loaded ball bearings 232.

The spring loaded ball bearings 232 are held in position within groove 222 by a slidable, spring-loaded ring 234, which retracts toward the flexible blower hose 204 in retract position 236 as shown in FIG. 8. Retract position 236 permits the bearings 232 to be pushed outwardly to their default position, thereby releasing the hose connector 224 from the groove 222.

The male piece 214 can slip into female portion of the hose connector 224, and the bearings 232 can lock in the groove 222. When the spring loaded ring 234 is released to its default position 238 as shown in FIG. 6, the bearings 232 are firmly locked in the groove 222. Merely moving the spring loaded ring 234 to its retract position 236 permits an easy release of bearings 232 from groove 222, thereby releasing flexible blower hose 204 from mask hose 206.

With FIG. 1 and FIG. 5, this particular structure of having the hose disconnection assembly 210 located directly at the belt 118 avoids direct pressure on the mask 202 and provides a stress free attachment thereto. Thus, the mask hose 206 is connected directly to the belt 118 by the belt ring 212. So when the person 110 moves, the hose 232 merely moves without applying pressure to the mask 202. This is especially true in view of the belt clip 240.

The belt clip 240 of FIG. 7 includes a clip housing loop 226, which is sewn or secured to the belt 118 shown in FIG. 1 of the person 110. Loop 226 mounts belt clip 240 to the belt 118.

This belt clip 240 provides for a belt ring 224 to receive the hose 232 by means of holding ring 216. In this fashion, the person 110 wearing the mask 202 has control of where the hose 232 is and avoids pulling on the mask 202. Thus, substantial problems are solved in the wearing of this mask 202 with the attachments herein described.

Referring back to FIG. 6, the flexible blower hose 204 is clipped, glued or otherwise secured to male piece 214 in a female/male relationship. Preferably, hose clamp 228 secures the blower hose 204 male piece 214. Groove 222 is oppositely disposed therefrom and receives bearing assembly 230.

The bearing assembly 230 has a hose end 300 to receive the blower hose 204. A second hose clamp, 228 provides the securing mechanism for blower hose 204 to hose end 300 in a male/female relationship. Hose end 300 is oppositely disposed from bearings 232.

This application—taken as a whole with the specification, claims, abstract, and drawings—provides sufficient information for a person having ordinary skill in the art to practice the invention disclosed and claimed herein. Any measures necessary to practice this invention are well within the skill of a person having ordinary skill in this art after that person has made a careful study of this disclosure.

Because of this disclosure and solely because of this disclosure, modification of this method and apparatus can become clear to a person having ordinary skill in this particular art. Such modifications are clearly covered by this disclosure.

What is claimed and sought to be protected by Letters Patent of the United States is:

1. An apparatus for providing breathable air to an enclosed space the apparatus including an air source motor connected by a hose assembly to a mask assembly, the apparatus further comprising:

(a) the air source motor having a housing;

(b) the housing having a blower motor mounted therein at a first end thereof;

(c) the housing having a filter assembly mounted therein at a second end thereof;

(d) the first end being oppositely disposed from the second end;

(e) the hose assembly including means to provide a stress free attachment to the mask assembly; and (f) the housing including an air exhaust means for passing air to and through the hose assembly situated between the blower motor and the filter assembly spaced apart from the blower motor;

(g) the housing including a handle for carrying the apparatus;

h) the housing including a support means for positioning the housing;

(i) the filter assembly including a filter filling the second end of the housing;

(j) the filter assembly further including an end closure member adjacent to the filter in order to support the filter at the second end;

(k) the filter assembly further including a screen adjacent to the filter and oppositely disposed from the end closure member;

(l) a screen support means adjacent to the screen, and oppositely disposed from the filter within the housing;

(m) the support means having a first stand and a second stand;

(n) the first stand and the second stand being oppositely disposed from the handle; and (o) the air exhaust means being between the first stand and the second stand.

2. The apparatus of claim 1 further comprising the air source motor providing at least five liters of air per minute to the mask assembly.

3. The apparatus of claim 1 further comprising the air source motor providing five liters to twenty five liters of air per minute to the mask assembly.

4. The apparatus of claim 1 further comprising the air source motor providing ten liters to twenty liters of air per minute to the mask assembly.

5. The apparatus of claim 1 further comprising:

(a) the hose assembly being flexible and easily controlled;

(b) the hose assembly providing a low pressure and high volume of air to the mask assembly from the air source motor; and (c) the hose assembly including a motor hose, a disconnecting fitting, and a mask hose.

6. The apparatus of claim 5 further comprising:

(a) the motor hose being secured at a first motor hose end to the air exhaust and at a second motor hose end to the disconnecting fitting;

(b) the mask hose being secured at a first mask hose end to the mask assembly and at a second mask hose end to the disconnecting fitting; and (c) the disconnecting fitting providing a means to disconnect the motor hose from the mask hose.

7. The apparatus of claim 6 further comprising:

(a) the second motor hose end including a female fitting to connect to a first male fitting of the disconnecting fitting;

(b) the disconnecting fitting being mounted on a belt to be worn in order to provide the means for a stress free attachment to the mask assembly; and (c) the second mask hose end including a female fitting to connect to a second male fitting of the disconnecting fitting.

8. The apparatus of claim 7 further comprising:

(a) the mask assembly further including the belt to be worn and a hook assembly for attaching the hose assembly to the belt;

(b) the hook assembly including a ring selected from the group consisting of a split ring and a snap ring; and (c) the hook assembly cooperating with a snap clip on the belt to provide the means for a stress free attachment to the mask assembly.

9. The apparatus of claim 1 further comprising:

(a) the mask assembly further including a belt to be worn and a hook assembly for attaching the hose assembly to the belt;

(b) the hook assembly including a ring selected from the group consisting of a split ring and a snap ring;

(c) the hook assembly cooperating with a ring on a belt clip;

(d) the mask assembly further including a mask to be worn over a face; and (e) the mask including an exhalation valve, a mouth piece adapter, and a strap assembly to hold the mask in position.

10. The apparatus of claim 1 further comprising:

(a) the blower having a first impeller and a second impeller;

(b) the first impeller and the second impeller combining to route the incoming air away from the blower motor and minimize air contact with the motor; and (c) the first impeller and the second impeller combining to increase air volume at the exhaust port.

11. The apparatus of claim 10 further comprising:

(a) a first housing support and a second housing support being secured in the housing between the exhaust port and the filter; and (b) the first housing support and the second housing support being circular, apertured disks mounted in the housing.

12. The apparatus of claim 11 further comprising:

(a) a first circular spacer being positioned to support the blower motor and oppositely disposed from the filter; and (b) the first circular spacer being positioned in the housing to both enclose the housing and support the blower motor.

13. The apparatus of claim 12 further comprising:

(a) the air exhaust means including an exhaust port, an exhaust air manifold and a hose attachment means;

(b) the exhaust air manifold providing a housing for the exhaust port; and (c) the hose attachment means receiving the hose assembly.

14. An apparatus for providing breathable air to an enclosed space including an air source motor connected by a hose assembly to a mask assembly comprising:

the air source motor having a housing;

the housing having a blower motor mounted therein at a first end thereof;

the housing having a filter assembly mounted therein at a second end thereof;

the first end being oppositely disposed from the second end;

the housing including an air exhaust means for passing air to and through the hose assembly situated between the blower motor and the filter assembly spaced apart from the blower motor;

the hose assembly being flexible and easily controlled;

the hose assembly providing a low pressure and high volume of air to the mask assembly from the air source motor;

the hose assembly including a motor hose, a disconnecting fitting, and a mask hose;

the motor hose being secured at a first motor hose end to the air exhaust and at a second motor hose end to the disconnecting fitting;

the mask hose being secured at a first mask hose end to the mask assembly and at a second mask hose end to the disconnecting fitting;

the mask hose including a switch operably connected to the blower motor in order to operate the blower motor;

the disconnecting fitting providing a means to disconnect the motor hose from the mask hose;

the second motor hose end including a female fitting connected to a first male fitting of the disconnecting fitting;

the second mask hose end including a female fitting to connect to a second male fitting of the disconnecting fitting;

the mask assembly further including a belt to be worn and a hook assembly for attaching the hose assembly to the belt;

the hook assembly including a ring selected from the group consisting of a split ring and a snap ring;

the hook assembly cooperating with a ring on a belt clip;

the housing including a handle for carrying the apparatus;

the housing including a support means for positioning the housing;

the filter assembly including a filter filling the second end of the housing;

the filter assembly further including an end closure member adjacent to the filter in order to support the filter at the second end;

the filter assembly further including a screen adjacent to the filter and oppositely disposed from the end closure member;

a screen support means adjacent to the screen, and oppositely disposed from the filter within the housing;

the support means having a first stand and a second stand;

the first stand and the second stand being oppositely disposed from the handle; and the air exhaust means being between the first stand and the second stand.

15. The apparatus of claim 14 further comprising:

(a) the blower having a first impeller and a second impeller;

(b) the first impeller and the second impeller combining to route the incoming air away from the blower motor and minimize air contact with the motor;

(c) the first impeller and the second impeller combining to increase air volume at the exhaust port;

(d) a first housing support and a second housing support being secured in the housing between the exhaust port and the filter;

(e) the first housing support and the second housing support being circular, apertured disks mounted in the housing;

(f) a first circular spacer being positioned to support the blower motor and oppositely disposed from the filter;

(g) the first circular spacer being positioned in the housing to both enclose the housing and support the blower motor;

(h) the air exhaust means including an exhaust port, an exhaust air manifold and a hose attachment means;

(i) the exhaust air manifold providing a housing for the exhaust port;

(j) the hose attachment means receiving the hose assembly;

(k) the disconnecting fitting including a tubular member having an external groove therein and a bearing assembly;

(l) the bearing assembly having a first bearing end connected to the motor hose end to form the motor hose connection to the disconnecting fitting;

(m) the bearing assembly having a second bearing end with at least one releasable spring loaded ball bearing therein;

(n) the tubular member fitting into second bearing end in a male/female relation in order for the at least one releasable spring loaded ball bewaring to fit into the external groove;

(o) the second mask hose end being secured to the tubular member and oppositely disposed from the external groove; and (p) the tubular member being easily releasable from the second bearing end.

* * * * *